US005269152A

United States Patent [19]

Park

[11] Patent Number: 5,269,152

[45] Date of Patent: Dec. 14, 1993

[54] TEMPERATURE CONTROL METHOD FOR REFRIGERATOR

[75] Inventor: Seong Su Park, Kyungsangnam, Rep. of Korea

[73] Assignee: Goldstar Co., Ltd., Seoul, Rep. of Korea

[21] Appl. No.: 944,179

[22] Filed: Sep. 11, 1992

[30] Foreign Application Priority Data

Sep. 12, 1991 [KR] Rep. of Korea ..... 15923/1993

[51] Int. Cl.[5] ..... F25D 17/06

[52] U.S. Cl. ..... 62/89; 62/186; 454/329

[58] Field of Search ..... 62/180, 89, 186, 209; 454/329

[56] References Cited

U.S. PATENT DOCUMENTS 3,375,677 4/1969 Bright et al. ..... 62/89

4,296,611 10/1981 Griffin et al. ..... 62/89

*Primary Examiner*—William E. Wayner

*Attorney, Agent, or Firm*—Birch, Stewart, Kolasch & Birch

[57] ABSTRACT

A temperature control method for a refrigerator which is capable of promptly restoring temperatures inside a freezing compartment and a refrigerating compartment by controlling a rotation speed of a fan of an operation control system of the refrigerator via a rotation speed-variable control unit to allow cooling air to flow into the freezing compartment and the refrigerating compartment in inverse proportion to each other in response to the temperatures inside the freezing compartment and the refrigerating compartment.

3 Claims, 5 Drawing Sheets

TEMPERATURE CONTROL METHOD FOR REFRIGERATOR

BACKGROUND OF THE INVENTION

1. Field of the Invention

The present invention relates to a temperature control method for use in a refrigerator which enables the amount of cooling air flowing into a freezing compartment or a refrigerating compartment to be selectively controlled to control the temperatures inside the freezing compartment and the refrigerating compartment by variably controlling the rotational speed of a fan.

2. Description of the Prior Art

A conventional operation control system for use in a refrigerator, shown in FIG. 1, comprises a compressor 1, a compressor driving unit 2, a fan 3, a fan driving unit 4, a first temperature detecting unit 5 for detecting a temperature inside a freezing compartment, a power supply 7 for supplying an electric power to each operational unit, a door-open detecting unit 8 for detecting an open door a second temperature detecting unit 9 for detecting a temperature inside a refrigerating compartment, and a microprocessor 6 for controlling the operation of the compressor 1 and the fan 3 in response to the detection signals from the first and second temperature detecting units 5 and 9 and the door-open detecting unit 8.

Conventionally, the temperature control is executed in such an operation control system for use in a refrigerator as follows.

When electric power is supplied to respective operational units as a source voltage through the power supply 7, the microprocessor 6 controls the temperature of the refrigerator in a manner as shown in FIG. 2.

That is, the microprocessor 6 executes a cooling operation by driving the compressor 1 and the fan 3 via the compressor driving unit 2 and the fan driving unit 4, respectively. Also, the microprocessor 6 checks as to whether an open door is detected during the cooling operation via the door-open detecting unit 8.

At this moment, when an open door is not detected, the fan is driven and it is checked as to whether the currently detected temperatures inside the freezing compartment and refrigerating compartment are lower than respective set temperatures. On the other hand, when an open door is detected, the operation of the fan 3 is stopped and then it is checked as to whether the currently detected temperatures inside the freezing compartment and the refrigerating compartment are lower than respective set temperatures. The set temperatures are indicative of temperatures for cooling the freezing compartment and the refrigerating compartment, respectively, which are set by a user. The currently detected temperatures which are detected at the first and second temperature detecting units 5 and 9 are compared with the user's set temperatures, respectively.

When any one of the currently detected temperatures is higher than the user's set temperature, the freezing compartment or the refrigerating compartment has to be further cooled. Thus, the compressor 1 and the fan 3 are continuously driven and the door-open detecting step is executed. On the other hand, as a result of the comparison when both the currently detected temperatures are lower than comparison when both the currently detected temperatures are lower than the user's set temperatures, the cooling operation is ended by stopping the compressor 1 and the fan 3.

Thereafter, the temperatures inside the freezing compartment and the refrigerating compartment are continuously detected in order to check whether they are lower than the set temperatures, and the cooling operation is controlled in response to the checking result so that the temperatures inside the freezing compartment and the refrigerating compartment are maintained below the set temperatures.

In such a conventional temperature control method, since the rotation speed of the fan is always maintained constant and the driving of the fan is associated with the driving of the compressor, either the freezing compartment or the refrigerating compartment may be controlled at a desired set temperature while one of them may be unnecessarily overcooled.

For example, in the case where a current temperature inside the freezing compartment is lower than the set temperature for the freezing compartment while a current temperature inside the refrigerating compartment is higher than the set temperature for the refrigerating compartment, the cooling operation is continued until the temperature inside the refrigerating compartment becomes lower than the set temperature, thereby causing the freezing compartment to be overcooled. In contrast, in the case where the temperature inside the refrigerating compartment is lower than its set temperature while the temperature inside the freezing compartment is higher than its set temperature, the cooling operation is executed until the temperature inside the freezing compartment comes to its set temperature, thereby causing the refrigerating compartment to be overcooled.

Accordingly, there are disadvantages in the conventional temperature control method such that only one of the freezing and refrigerating compartments may be controlled at its desired temperature, but the other compartment is overcooled or insufficiently cooled. Such a problem becomes more serious when the door is frequently opened and closed.

SUMMARY OF THE INVENTION

Accordingly, it is an object of the present invention to provide a temperature control method for use in a refrigerator which is capable of controlling the temperatures inside both the freezing compartment and the refrigerating compartment at a desired cooling temperature by varying the amount of the cooling air flowing into the freezing compartment and the refrigerating compartment and adjusting the cooling speed of both the compartments in inverse proportion to each other.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to a temperature control method for a refrigerator which comprises a cooling operation starting step for turning on a compressor and a fan, a temperature comparing step for controlling a driving of the fan in response to a detection of a door-open, comparing a current temperature inside a freezing compartment with a set temperature for the freezing compartment, and comparing a temperature inside a refrigerating compartment with a set temperature for the refrigerating compartment, a reference controlling step for controlling a rotation speed of the fan to allow cooling air to flow into the freezing compartment and the refrigerating compartment at a predetermined rate when the current temperatures inside the freezing compartment and the refrigerating compartment are higher than each of the set temperatures, a refrigerating compartment high-cooling controlling step for controlling the rotation speed of the fan to allow cooling air to flow into the refrigerating compartment in a larger amount than the rate at the step when the temperature inside the freezing compartment is lower than the set temperature and the temperature inside the refrigerating compartment is higher than the set temperature, a freezing compartment high-cooling controlling step for controlling the rotation speed of the fan to allow cooling air to flow into the freezing compartment in a larger amount than the rate at the third step when the temperature inside the refrigerating compartment is lower than its set temperature and the temperature inside the freezing compartment is higher than its set temperature, and a cooling operation stopping step for stopping the cooling operation by turning off the compressor and the fan when the temperatures inside both the freezing compartment and the refrigerating compartment are lower than their set temperatures.

In the present invention, the temperatures inside the freezing compartment and the refrigerating compartment are controlled by variably controlling the rotation speed of the fan upon comparing the current temperatures inside the freezing compartment and the refrigerating compartment with the set temperatures at the temperature comparing step.

BRIEF DESCRIPTION OF THE DRAWINGS

The present invention will become more fully understood from the detailed description given hereinbelow and the accompanying drawings which are given by way of illustration only, and thus are not limitative of the present invention, wherein;

FIGS. 3A and 3B are explanatory views showing the cooling air stream in accordance with the rotational speed of a fan for explaining the principle of the present invention, in which FIG. 3A shows a case in a high-speed and FIG. 3B shows a case in a low-speed;

DESCRIPTION OF THE PREFERRED EMBODIMENTS

Figure 1:
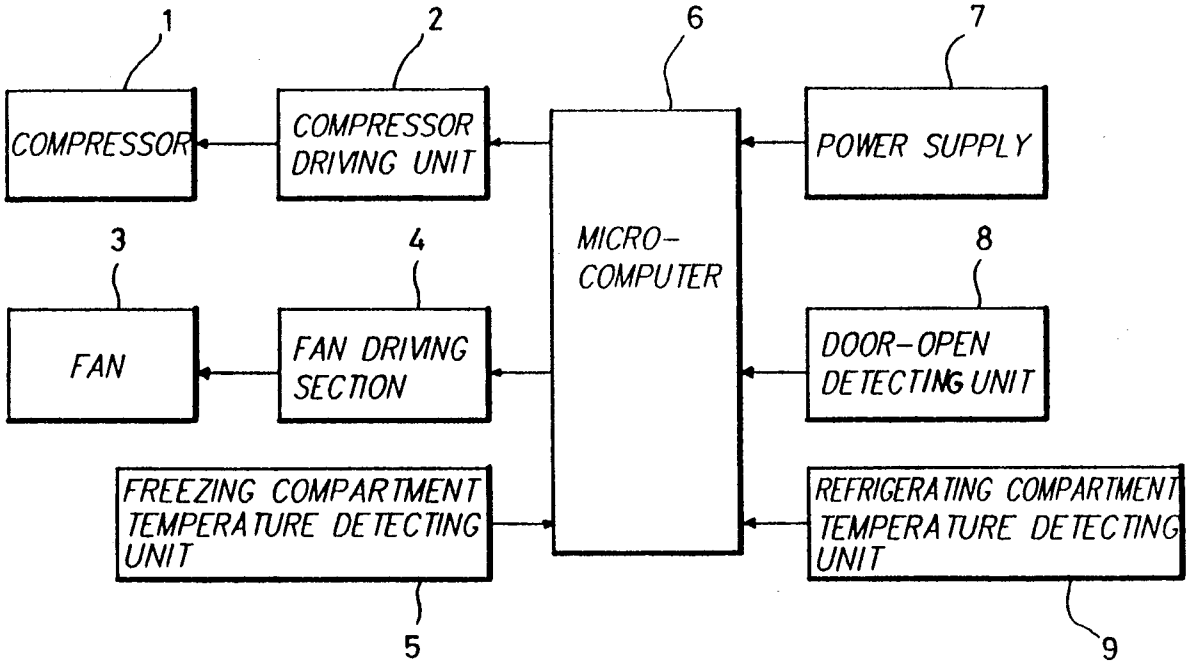
FIG. 1 PRIOR ART
FIG. 1 is a block diagram of a conventional operation control system for a refrigerator.
Figure 2:
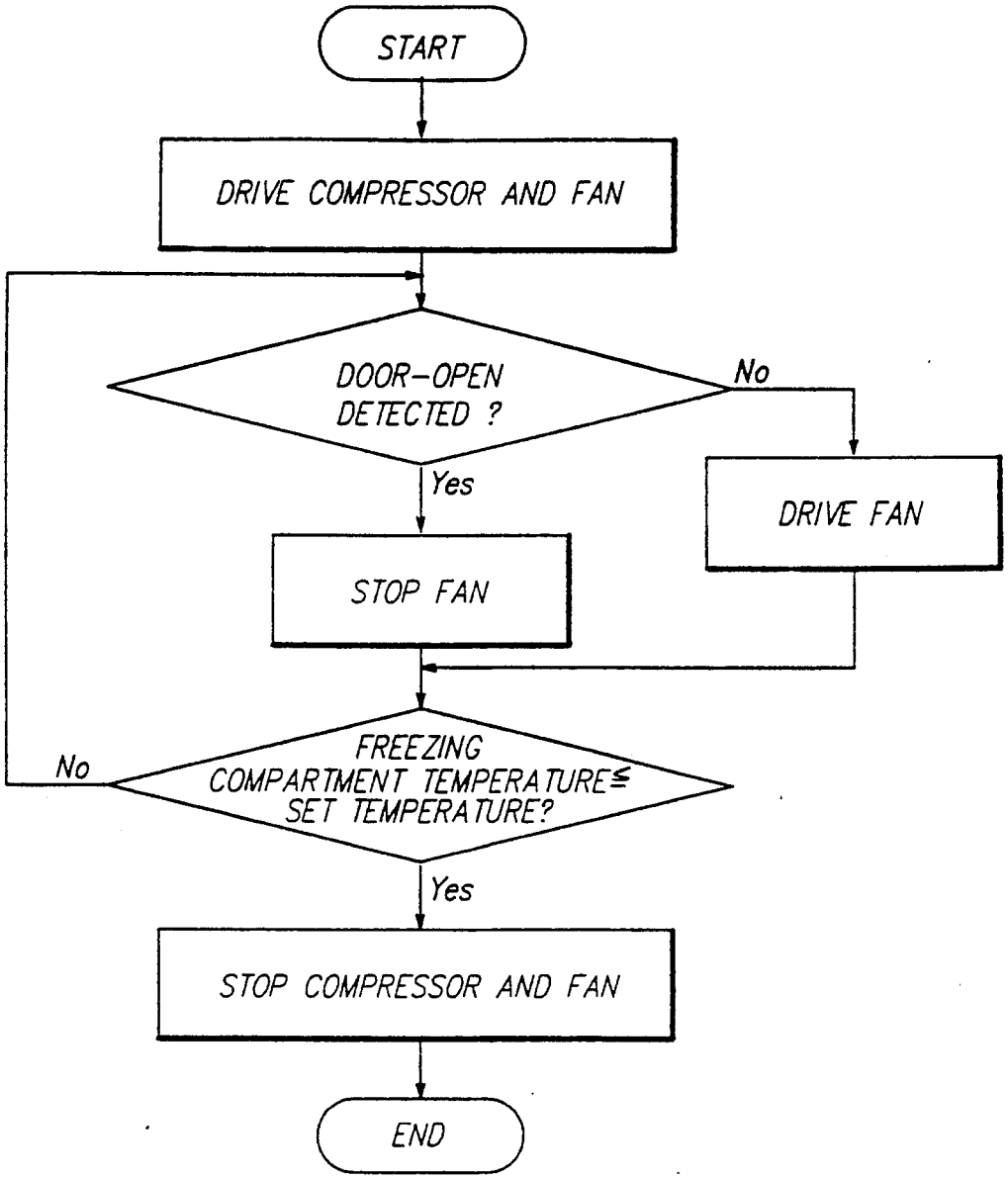
FIG. 2 PRIOR ART
FIG. 2 is a flow-chart of a conventional temperature control for a refrigerator.
Figure 3A:
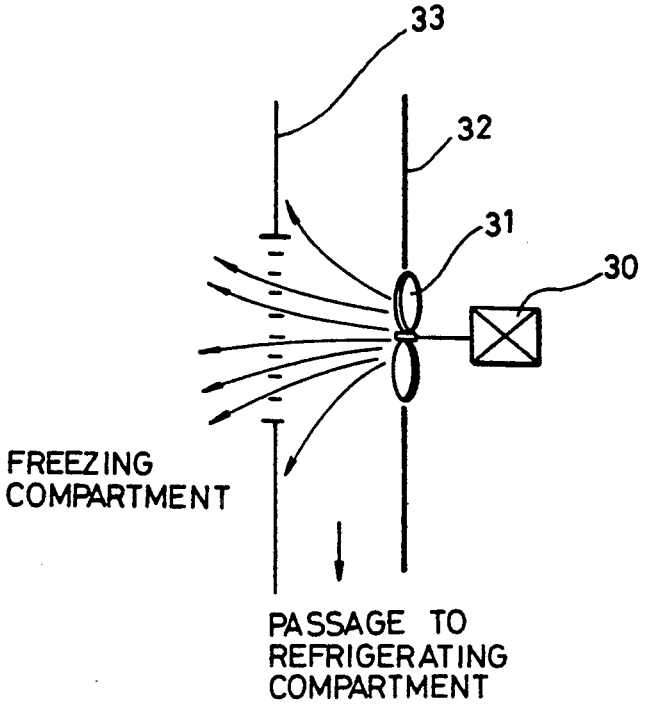
Figure 3B:
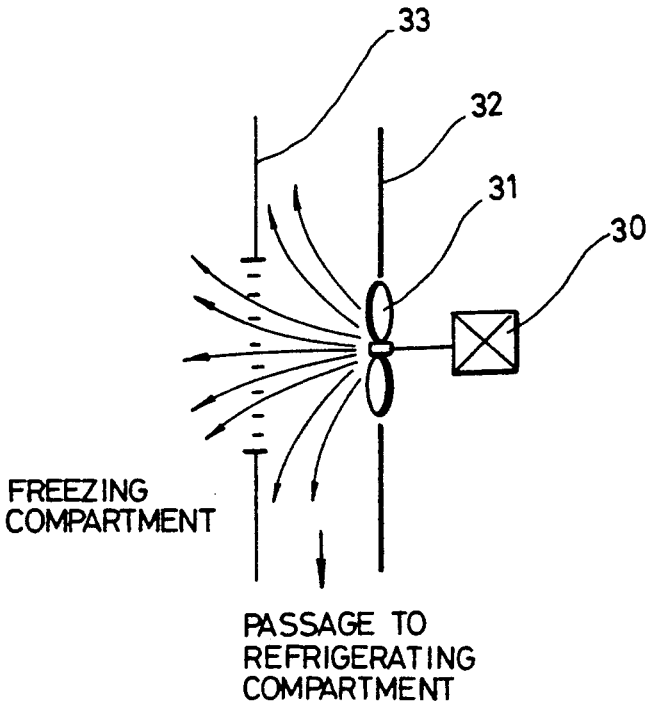

Referring now in detail to the drawings for the purpose of illustrating preferred embodiments of the present invention, the temperature control method for use in a refrigerator uses, as shown in FIGS. 3A and 3B, an indirect cooling method which distributes and blows a cooling air flowing between a shroud 32 and a grill 33 into the freezing compartment and the refrigerating compartment.

In such an indirect cooling method, when a rotation speed of a fan 31, for example an axial-flow type fan, is high, the cooling air stream proceeds forward while in case the rotation speed is low, the cooling air stream is scattered laterally.

Accordingly, when the fan 31 is controlled at a higher speed than a reference speed via a speed-variable motor 30 the amount of cooling air, which flows through a cooling air passage 34 into the freezing compartment, is larger, as shown in FIG. 3A, while the amount of cooling air, which flows into the refrigerating compartment, becomes smaller.

On the contrary, when the fan 31 is controlled at a lower speed than the reference speed via the speed-variable motor 30, the amount of cooling air, which flows through the cooling air passage 34 into the freezing compartment, is smaller, as shown in FIG. 3B, while the amount of cooling air which flows into the refrigerating compartment, becomes larger.

In the above, the reference speed is indicative of a rotation speed of a fan which allows the cooling air to flow almost equivalently into the freezing compartment and the refrigerating compartment. That is, the reference speed is a rotation speed of a fan in case that cooling air is controlled to be introduced to the freezing compartment and the refrigerating compartment at almost the same rate in the normal cooling operation.

In the present invention, the temperatures inside the freezing compartment and the refrigerating compartment are controlled by varying the amount of cooling air distributed to the respective compartments in response to the rotation speed of the fan.

According to the present invention, the temperature control method for a refrigerator comprises a cooling operation starting step (S10) for turning on a compressor and a fan, a temperature comparing step (S20) for controlling a driving of the fan in response to a detection of a door-open condition comparing a current temperature inside a freezing compartment with a set temperature for the freezing compartment, and comparing a temperature inside a refrigerating compartment with a set temperature for the refrigerating compartment, a reference controlling step (S30) for controlling a rotation speed of the fan to allow cooling air to flow into the freezing compartment and the refrigerating compartment at a predetermined rate when the current temperatures inside the freezing compartment and the refrigerating compartment are higher than each of the set temperatures, as a result of the comparison at the step (S20), a refrigerating compartment high-cooling controlling step (S40) for controlling the rotation speed of the fan to allow cooling air to flow into the refrigerating compartment in a larger amount than the rate at step (S30) when the temperature inside the freezing compartment is lower than the set temperature and the temperature inside the refrigerating compartment is higher than the set temperature, as a result of the comparision at step (S20), a freezing compartment high-cooling controlling step (S50) for controlling the rotation speed of the fan to allow cooling air to flow into the freezing compartment in larger amount than the rate at step (S30) when the temperature inside the refrigerating compartment is lower than its set temperature and the temperature inside the freezing compartment is higher than its set temperature, as a result of the comparison at step (S20), and a cooling operation stopping step (S60) for stopping the cooling operation by turning off the compressor and the fan when the temperatures inside both the freezing compartment and the refrigerating compartment are lower than their set temperatures, as a result of the comparison at step (S20).

Figure 4:
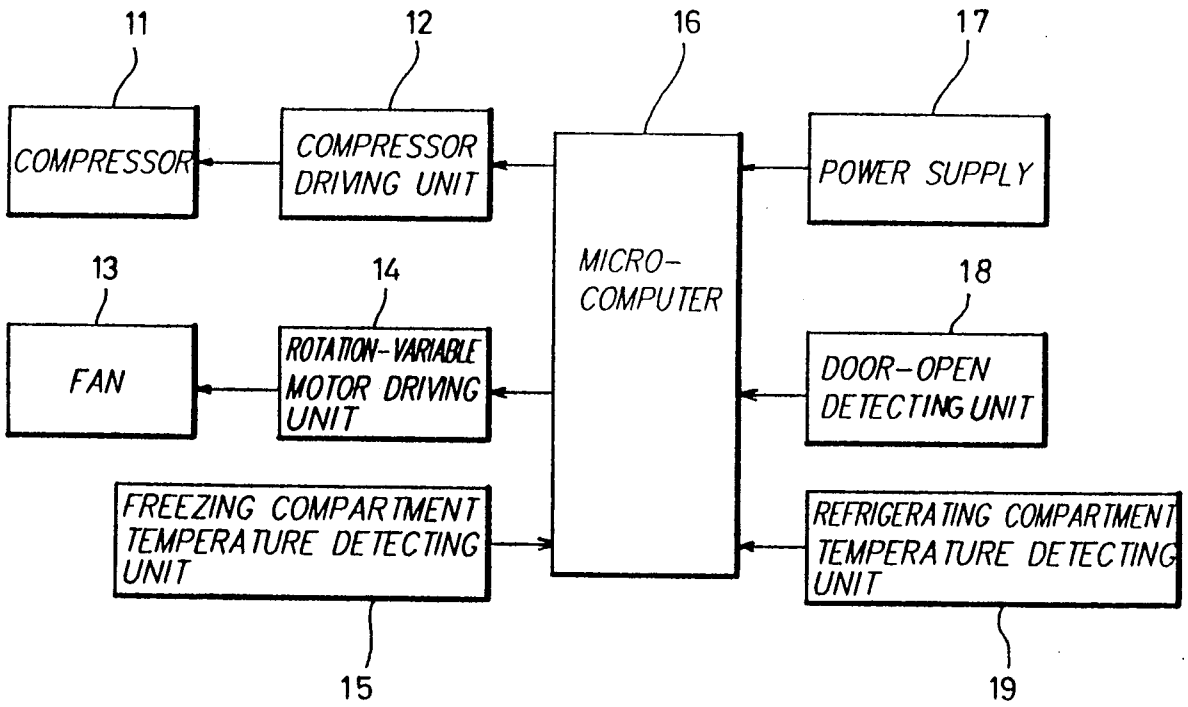
FIG. 4 is a block diagram of an operation control system for use in a refrigerator according to the present invention.

The operation control system for a refrigerator to which the temperature control method of the present invention is applied, is shown in FIG. 4, which comprises a compressor 11 for compressing refrigerant in a refrigerant circulation cycle of a refrigerator, a compressor driving unit 12 for controlling the driving of the compressor 11, a fan 13 for blowing cooling air into a freezing compartment and a refrigerating compartment in a variable distributing manner according to a rotation speed, a rotation speed-variable motor driving unit 14 for variably controlling the rotation speed of the fan, a first temperature detecting unit 15 for detecting a temperature inside the freezing compartment, a power supply 17 for supplying an operation voltage to respective operational units, a door-open detecting unit 18 for detecting a door-open of a refrigerator, a second temperature detecting unit 19 for detecting a temperature inside the refrigerating compartment, and a microprocessor 16 for controlling the driving of the compressor 11 and the fan 13 and the rotation speed of the fan 13 in response to the detecting signals from the first and second temperature detecting units 15 and 19 and the door-open detecting unit 18.

The temperature control method of the present invention will be described in detail.

Figure 5:
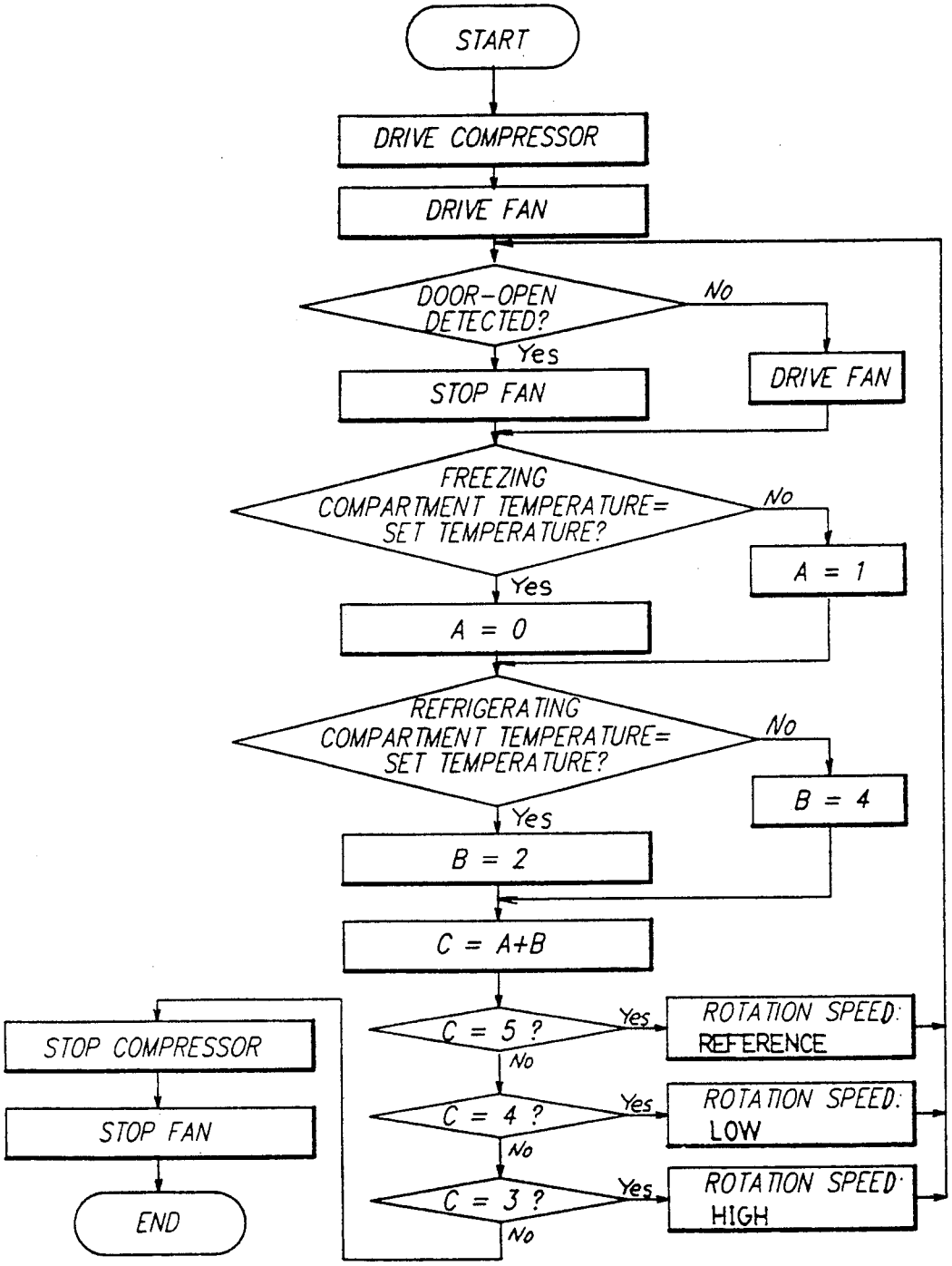
FIG. 5 is a flow-chart showing a temperature control method according to the present invention.

When electric power is supplied to each of the operation units as an operation voltage upon the control of the microprocessor 16, a condition door-open is detected and inputted to the microprocessor 16 by the door-open detecting unit 18, and current temperatures inside the freezing compartment and the refrigerating compartment are detected and inputted to the microprocessor 16 by the first and second temperature detecting units 15 and 19. As a result, the microprocessor 16 controls the driving of the compressor 11 and the fan 13 in response to the detection signals from the first and second temperature detecting units 15 and 19 and the door-open detecting unit 18, thereby controlling the temperature of refrigerator in accordance with the flow-chart of the FIG. 5.

Upon supplying electric power, the microprocessor 16 executes a cooling operation by driving the compressor 11 and the fan 13. At this moment, the fan 13 is controlled at a reference speed in the initial starting.

When the cooling operation is started, a temperature comparing step (S20) is executed in which a door-open detection signal from the door-open detecting unit 18 is checked by the microprocessor 16. At this moment, when a door-open condition is detected, the fan 13 is stopped, while the fan 13 is controlled in response to the door-open condition when a door is not opened or when a door-close condition is detected.

Thereafter, a current temperature inside the freezing compartment, which has been detected at the first temperature detecting unit 15, is compared with a set temperature for the freezing compartment, which has been set by a user. When the current temperature inside the freezing compartment is lower than its set temperature as a result of the temperature comparison, it is determined that the temperature inside the freezing compartment is satisfiable and thus a variable A is set to zero (A="0"). While in case the current temperature inside the freezing compartment is higher than its set temperature as a result of the temperature comparison, it is determined that the temperature inside the freezing compartment is unsatisfiable and thus the variable A is set to "1" (A="1").

Thereafter, a current temperature inside the refrigerating compartment, which has been detected at the second temperature detecting unit 19, is compared with a set temperature, which has been set by a user. When the current temperature inside the refrigerating compartment is lower than its set temperature as a result of the temperature comparison, it is determined that the temperature inside the refrigerating compartment is satisfiable and thus a variable B is set to "2" (B="2"). While in case the current temperature inside the refrigerating compartment is higher than its set temperature as a result of the temperature comparison, it is determined that the temperature inside the refrigerating compartment is unsatisfiable and thus the variable B is set to "4" (B="4").

When it is determined as to whether the temperatures inside the freezing compartment and the refrigerating compartment are unsatisfiable, the variables A and B are added up (C=A+B) and the rotation speed of the fan 13 is controlled in response to the adding resultant (C).

When the adding resultant (C) is "5", this means that the temperature inside the freezing compartment is higher than its set temperature and the temperature inside the refrigerating compartment is higher than its set temperature. Thus, the reference controlling step (S30) is executed by controlling the rotation speed of the fan at a reference speed. That is, in case both the temperatures inside the freezing compartment and the refrigerating compartment are unsatisfiable (C="5"), the rotation speed of the fan is controlled at a reference speed so that cooling air is distributed to the freezing compartment and the refrigerating compartment at a proper rate.

When the adding resultant (C) is not "5", it is discriminated as to whether the adding resultant (C) is "4". When the value (C) is "4", it means that the temperature inside the freezing compartment is lower than its set temperature and the temperature inside the refrigerating compartment is higher than its set temperature. Thus, the refrigerating compartment high-cooling controlling step (S40) is executed by controlling the rotation speed of the fan 13 at a lower speed than the reference speed. That is, the fan 13 is so controlled as to blow more cooling air into the refrigerating compartment than the case as in the reference controlling step (S30).

And, when the adding resultant (C) is not "4", it is discriminated as to whether the adding resultant (C) is "3". When the value (C) is "3", it means that the temperature inside the freezing compartment is higher than its set temperature and the temperature inside the refrigerating compartment is lower than its set temperature. Thus, the refrigerating compartment high-cooling controlling step (S50) is executed by controlling the rotation speed of the fan 13 at a higher speed than the reference speed. That is, the fan 13 is so controlled as to blow more cooling air into the freezing compartment than the case as in the reference controlling step (S30).

While in case that the adding resultant (C) is not "3", it means that both the temperatures inside the freezing compartment and the refrigerating compartment are lower than their respective set temperatures. Thus, the cooling operation stopping step (S60) is executed by turning off the compressor 11 and the fan 13.

Accordingly, it is possible to selectively supply cooling air to the freezing compartment and the refrigerating compartment by variably controlling the rotation speed of the fan. That is, the cooling rate is controlled in inverse proportion to each other with respect to the freezing compartment and the refrigerating compartment so that it is possible to prevent one compartment from being overcooled or the cooling operation from being stopped at a higher temperature than the set temperature.

Thereafter, the temperature comparing step (S20) is executed to turn on the compressor if any one of the compartments is in an unsatisfiable temperature condition, and to control the rotation speed of the fan in response to the temperature conditions of the freezing compartment and the refrigerating compartment based on the temperature comparison at the temperature comparing step (S20), thereby promptly controlling the temperatures inside the freezing compartment and the refrigerating compartment in a satisfactory manner.

The invention being thus described, it well be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. A temperature control method for a refrigerator, comprising:

a cooling operation starting step (S10) for turning on a compressor and a fan;

a temperature comparing step (S20) for controlling a driving of said fan in response to a detection of a door-open, comparing a current temperature inside a freezing compartment with a set temperature for the freezing compartment, and comparing a temperature inside a refrigerating compartment with a set temperature for the refrigerating compartment;

a reference controlling step (S30) for controlling a rotation speed of the fan to allow cooling air to flow into said freezing compartment and said refrigerating compartment at a predetermined rate when the current temperatures inside the freezing compartment and the refrigerating compartment are higher than each of the set temperatures, as a result of the comparison at said step (S20);

a refrigerating compartment high-cooling controlling step (S40) for controlling the rotation speed of the fan to allow cooling air to flow into the refrigerating compartment in a larger amount than the rate at said step (S30) when the temperature inside the freezing compartment is lower than the set temperature and the temperature inside the refrigerating compartment is higher than the set temperature, as a result of the comparison at said step (S20);

a freezing compartment high-cooling controlling step (S50) for controlling the rotation speed of the fan to allow cooling air to flow into the freezing compartment in a larger amount than the rate at said step (S30) when the temperature inside the refrigerating compartment is lower than its set temperature and the temperature inside the freezing compartment is higher than its set temperature, as a result of the comparison at said step (S20); and a cooling operation stopping step (S60) for stopping the cooling operation by turning off the compressor and the fan when the temperatures inside both the freezing compartment and the refrigerating compartment are lower than their set temperatures, as a result of the comparison at said step (S20).

2. A temperature control method for a refrigerator, wherein a fan of an operation control system is constituted in a manner that its rotation speed is variably controlled via a rotation speed-variable motor driving unit and the rotation speed of the fan is controlled in response to temperatures inside a freezing compartment and a refrigerating compartment to allow cooling air to flow into said freezing compartment and said refrigerating compartment in inverse proportion to each other.

3. The temperature control method for a refrigerator as claimed in claim 2, wherein said rotation speed controlling step comprises the steps of:

controlling the rotation speed of the fan at a reference speed when the temperature inside the freezing compartment is higher than a set temperature for the freezing compartment and the temperature inside the refrigerating compartment is higher than a set temperature for the refrigerating compartment;

controlling the rotation speed of the fan at a lower speed than the reference speed when the temperature inside the freezing compartment is lower than its set temperature and the temperature inside the refrigerating compartment is higher than its set temperature; and controlling the rotation speed of the fan at a higher speed than the reference speed when the temperature inside the freezing compartment is higher than its set temperature and the temperature inside the refrigerating compartment is lower than its set temperature.

* * * * *